US006000984A

United States Patent [19]

Degner

[11] Patent Number: 6,000,984

[45] Date of Patent: Dec. 14, 1999

[54] TOY BUILDING SET WITH PULL ELEMENTS

[75] Inventor: Vicki Sisse Degner, Langå , Denmark

[73] Assignee: INTERLEGO AG, Baar, Switzerland

[21] Appl. No.: 09/029,712

[22] PCT Filed: Sep. 13, 1996

[86] PCT No.: PCT/DK96/00388

§ 371 Date: May 11, 1998

§ 102(e) Date: May 11, 1998

[87] PCT Pub. No.: WO97/10035

PCT Pub. Date: Mar. 20, 1997

[30] Foreign Application Priority Data

Sep. 14, 1995 [DK] Denmark ..... 1023/95

[51] Int. Cl.[6] ..... A63H 33/04

[52] U.S. Cl. ..... 446/119; 446/96; 446/107; 446/490; 403/291

[58] Field of Search ..... 446/96, 103, 107, 446/119, 490; 403/291

[56] References Cited

U.S. PATENT DOCUMENTS 3,605,323 9/1971 Fischer .

*Primary Examiner*—Robert A. Hafer
*Assistant Examiner*—Laura Fossum
*Attorney, Agent, or Firm*—Kane, Dalsimer, Sullivan and Levy, LLP

[57] ABSTRACT

The element to be protected hereby is an element consisting of a pull string (2), chain, wire or the like having at each end a coupling device (3) which may be coupled onto a coupling stud (6). The element is characterised in that the string (2), the chain, etc., is mounted so high on the coupling device (3) that a momentum influences the coupling device (3) that twists the coupling device (3) off the coupling stud (6) despite the frictional force therebetween when the element is pulled.

9 Claims, 1 Drawing Sheet

TOY BUILDING SET WITH PULL ELEMENTS

Figure 1:
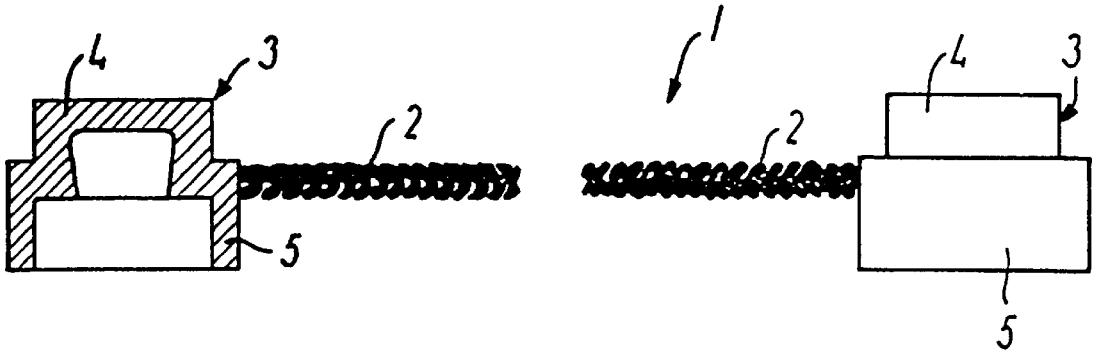

The present invention relates to a building set of the type described in the introductory part of claim 1, comprising a pull element with an elongated flexible element, such as a string, a wire or a chain, and wherein the one end of the elongated flexible element is secured to a coupling means which is provided on its underside with coupling means for frictionally interconnecting with one or more complementary coupling studs on another building element which is part of the building set.

In the building sets, these pull elements are used to connect portions of the constructions which may be built with the building set components. Thus, the pull elements may transmit pulling forces between the constructions which enables them to be used to connect e.g. individual carts in a train set, as lifting elements in e.g. cranes where the coupling means constitutes a crane hook or the like.

Known pull elements for this purpose are so designed that, at the area where it is secured to the coupling means, the elongated flexible element extends parallel with the coupling direction between the coupling means and the complementary coupling stud. This limits the pulling force which may be transmitted by the pull element to the frictional force between the coupling means and the complementary coupling stud, which limitation may be disadvantageous since it is often desired that this frictional force is comparatively small in order for individual blocks in the building set to be readily interconnected and separated.

Therefore, another type of pull elements is known where the elongated flexible element extends perpendicularly to the coupling direction between the coupling means and the complementary coupling stud whereby the pulling force which may be transmitted is not restricted by the frictional force therebetween. However, the latter type of known pull elements is associated with the drawback that the pull which may be transmitted may exceed the tensile strength of the elongated flexible element, or that of the connecting area between the elongated flexible element and the coupling means to which it is secured. In practice, this may cause the pull element to be destroyed or, at best, the construction onto which the pull element is mounted to break.

It is therefore the object of the present invention to provide a pull element of the type described in the introductory part whereby a pulling force may be transmitted that exceeds the frictional force between the coupling means and the complementary coupling stud without use of the element involving a risk that the pull element is destroyed by pulling forces that exceed the tensile strength of the element.

This is obtained according to the invention by the pull element described in the introductory part being provided in such a manner that the coupling means comprises only one rotationally symmetrical coupling skirt at its underside, and in that the elongated flexible element is connected to the coupling means at a point which is so far away from the underside of the coupling means that a pull in the elongated flexible element transversally to the coupling direction between the coupling means and the complementary coupling stud, said pull being smaller than the tensile strength of the elongated flexible element, will cause a twisting momentum on the coupling means, said twisting momentum being sufficiently large to pull the coupling means and the complementary coupling stud out of the frictional engagement, and that the elongated flexible element extends substantially perpendicularly to the coupling direction between the coupling means and the complementary coupling stud at the area where it is secured to the coupling means.

Claim 2 defines a convenient embodiment where it is further ensured that the pull element cannot be subject to plastic deformation during ordinary use of the element.

By the features defined in claim 3 an element is provided which is not destroyed during ordinary use if the elongated flexible element has a pull strength that exceeds the tensile strength in the connecting area between the elongated flexible element and the coupling means.

Preferably, the pull element is provided with coupling means at each of its ends, as it is featured in claim 4. The coupling means having the same design at all ends, as featured in claim 5, allows for a high degree of certainty that at least the one end of the pull element will release its frictional engagement before the element is destroyed whereby allowance is made for the increased frictional forces which may occur in case one of the complementary coupling studs on which the pull element is mounted has been deformed.

Claim 6 features a preferred embodiment wherein the coupling means also have complementary coupling studs whereby two or more ends on the pull element may be interconnected. This allows the pull element to be used for several different applications, still without the element being destroyed during ordinary play.

By securing the elongated flexible element in a casting process between the top and undersides of the coupling means, as featured in claim 7, it is allowed that a mould without cores may be used, and provided an injection moulding machine is used for this purpose it is possible to avoid core pulling.

As featured in claim 8, the elongated flexible element may in this context advantageously consist of a piece of woven or braided string whereby good securing of the elongated flexible element on the coupling means is obtained.

By providing the coupling means with a coupling stud and a coupling skirt only, in accordance with claim 9, it is obtained that only a very small force is required for the coupling of the coupling means onto a coupling stud on another element in the building set, and at the same time the interconnecting requires a comparatively large pulling force in order to pull the coupling means off the coupling stud by a lateral pull.

By designing the coupling stud as well as the coupling skirt to be rotationally symmetrical, the coupling stud may be mounted with many different orientations relative to each other on other elements in the building set without the elongated flexible element being deformed more than necessary, thereby allowing for the establishment of a direct pull in the pull element.

Figure 2:
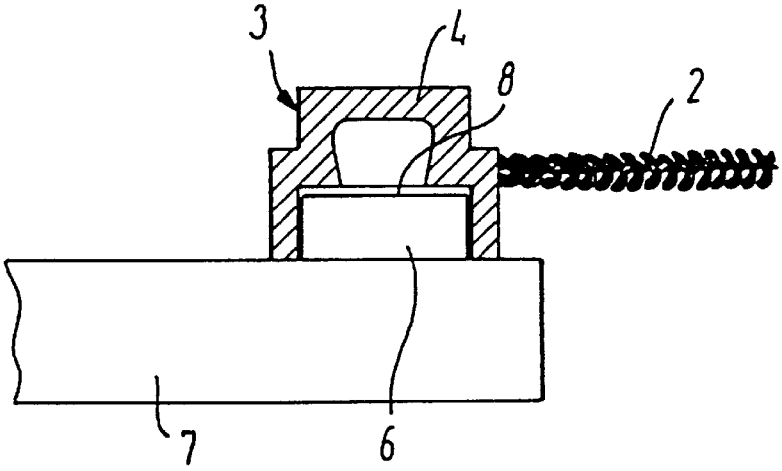

The invention will now be described in further detail with reference to the drawings, wherein FIG. 1 illustrates a pull element according to the invention, FIG. 2 illustrates the pull element according to FIG. 1 mounted on another element.

Thus, FIG. 1 illustrates a pull element 1 according to the invention where the central portion of the pull element 1 consists of a flexible piece of string 2 of any length, only a portion of the string 2 being shown in the drawing. At each of its ends the string 2 is provided with couplings 3 provided in an injection moulded plastics material, the one of which being shown in a sectional view to reveal the interior profile. Thus, the pull elements 1 are conveniently manufactured by the couplings 3 being secured on the string 2 by injection moulding thereby enabling the coarse surface of the string 2 to establish good and strong connection therebetween.

Each of the couplings 3 is provided in the form of a rotationally symmetrical unit and comprises a coupling stud 4 on its top surface and a coupling skirt 5 on its underside which is complementary relative to the coupling stud 4. Thereby the couplings 3 may be connected to each other or they may be mounted on a coupling stud 6 on another element 7 in the building set.

Thus, FIG. 2 illustrates how one of the couplings 3 is mounted on a coupling stud 6 on the element 7 which may be embodied in several ways, and either be a permanent part of a piece of toy or be composed of several elements (not shown). Thereby the pull element may be used e.g. as pulling string in a building set where the pull element may transmit pulling forces from one construction to another.

As will appear from FIG. 2, the string 2 is mounted so high on the coupling 3 that when the coupling 3 is mounted on the coupling stud 6 on the element 7, the entire mounting site is located above the uppermost surface 8 on the coupling stud 6 on the element 7.

Hereby it is possible when a pull is applied in the direction of the string 2, as shown in FIG. 2, that the coupling 3 will be influenced with a momentum which will be able to pull the coupling 3 off the coupling stud 6 without the string 2 or its attachment in the coupling 3 being destroyed.

According to the invention the mounting site for the string 2 on the coupling 3 is such that the height of the mounting site is above the uppermost surface 8 of the coupling stud 6, whereby the momentum applied to the coupling 3 by a pull in the string 2 may pull the coupling 3 off the coupling stud 6 without destroying the pull element 1 even though the frictional force between the coupling stud 6 and the coupling skirt 5 will try to keep them in position.

By selecting the mounting site of the string 2 on the coupling 3 the pulling force necessary to pull the coupling 3 off the coupling stud 6 may be regulated and adapted to e.g. the strength of the string 2 whereby it is ensured that neither the string 2 nor its mounting on the coupling 3 is destroyed.

It is obvious that the embodiment shown may be varied in many ways within the scope of the invention. Thus, the pull element may have different numbers of couplings, such as one or three and more. Moreover, it is not necessary that all ends of the pull elements are provided with couplings. Coupling studs as well as coupling skirts may also be provided in may other ways than the one shown which is rotationally symmetrical.

As regards the string 2, it may also be replaced by a chain, a line, a wire or the like without departing from the scope of the invention.

I claim:

1. A toy building set comprising:

at least one toy building element having coupling knobs at one side; and a pull element comprising an elongated flexible element having two ends, each of said two ends being secured to a coupling means, each of said coupling means having on its underside only one rotationally symmetrical coupling skirt, said coupling skirt being arranged for frictional engagement with only one of said coupling knobs in a mutual coupling direction;

wherein each end of said elongated flexible element is secured to said coupling means at a mounting site and extending from said mounting site perpendicularly to said mutual coupling direction, said mounting site being located on said coupling means at a height above a height of an uppermost surface of said coupling knob when said coupling means is frictionally engaged with said coupling knob, such that a pulling force on said elongated flexible element transversely to said mutual coupling direction, when said coupling skirt is frictionally engaged with one of said coupling knobs, causes a twisting momentum on the coupling means sufficient to pull the coupling means out of frictional engagement with said coupling knob.

2. A toy building set according to claim 1, wherein said pulling force on the elongated flexible element is less powerful than a pulling force which would cause a plastic elongation of the elongated flexible element.

3. A toy building set according to claim 1, wherein said pulling force on the elongated flexible element is less powerful than a pulling force which would cause a rupture the mounting site.

4. A toy building set according to claim 1, wherein the coupling means are identical.

5. A toy building set according to claim 1, wherein each of the coupling means have respective top surfaces that face away from their respective undersides, said top surfaces being provided with one or more coupling studs being adapted for frictional engagement with said rotationally symmetrical coupling skirt.

6. A toy building set according to claim 5, wherein the mounting site is disposed on said coupling means between the underside and the top surface, and wherein the coupling means are molded onto the elongated flexible element.

7. A toy building set according to claim 6, wherein the elongated flexible element consists of a braided or woven string.

8. A toy building set according to claim 5, wherein each of the coupling means has only one coupling stud on its top surface.

9. A toy building set according to claim 8, wherein the coupling stud is rotationally symmetrical.

* * * * *